United States Patent [19]

McCartney

[11] 4,313,695

[45] Feb. 2, 1982

[54] EARTH STRUCTURE STABILIZING METHOD, AND A FRICTION ROCK STABILIZER AND AN AXIAL EXTENSION THEREFOR

[75] Inventor: Clifford A. McCartney, Carnegie, Pa.

[73] Assignee: Ingersoll-Rand Company, Woodcliff Lake, N.J.

[21] Appl. No.: 110,129

[22] Filed: Jan. 7, 1980

[51] Int. Cl.[3] ..... E21D 21/00

[52] U.S. Cl. ..... 405/259; 405/252

[58] Field of Search ..... 405/259–261, 405/232–252; 411/61, 520, 521, 514

[56] References Cited

U.S. PATENT DOCUMENTS

| | | | |
|---|---|---|---|
| 3,899,893 | 8/1975 | Banerjee et al. | 405/259 |
| 4,052,860 | 11/1977 | Alterman | 405/259 |
| 4,098,087 | 7/1978 | Swain | 405/259 |
| 4,126,004 | 11/1978 | Lindeboom | 405/259 |
| 4,132,080 | 1/1979 | Hansen | 405/261 |

FOREIGN PATENT DOCUMENTS

| | | | |
|---|---|---|---|
| 93090 | 10/1958 | Norway | 405/259 |
| 215177 | 5/1924 | United Kingdom | 405/232 |
| 384977 | 12/1973 | U.S.S.R. | 405/232 |

*Primary Examiner*—Dennis L. Taylor

*Attorney, Agent, or Firm*—David W. Tibbott; Bernard J. Murphy

[57] ABSTRACT

The method aspect of the invention comprises stabilizing an earth structure by forming a plurality of concentric boreholes therein, and inserting, in each of the boreholes, a friction rock stabilizer. A friction rock stabilizer, so defined as to be useful in the method, comprises another aspect of the invention, the stabilizer having a plurality of concentric, tubular bodies. In this novel friction rock stabilizer, one of the tubular bodies defines an axial extension of another thereof. In addition, then, the invention further embraces the definition of a novel axial extension for a friction rock stabilizer.

10 Claims, 6 Drawing Figures

EARTH STRUCTURE STABILIZING METHOD, AND A FRICTION ROCK STABILIZER AND AN AXIAL EXTENSION THEREFOR

This invention pertains to methods and devices for stabilizing an earth structure, such as a roof or wall of a mine shaft or tunnel, and like subterranean openings, and in particular to so-called friction rock stabilizing methods and devices.

Friction rock stabilizers are those devices which were disclosed in U.S. Pat. No. 3,922,867, issued on Dec. 2, 1977, to James J. Scott. Broadly, they comprise a generally tubular body (for forced insertion into an earth structure borehole) the body being of substantially one cross-sectional configuration along substantially its full length, said body having a maximum transverse dimension predetermined to be larger than the maximum transverse dimension of the borehole in which it is to be inserted, whereby insertion of said body in such borehole causes circumferential compression and deformation of said body, the stabilizer being free of structure precluding such circumferential compression and deformation of said body, and said body being of material which, in response to such borehole insertion of said stabilizer (a) permits both said circumferential compression of said body, and a transverse deformation thereof as well, in the event of a shift in a plane transverse to the length of said stabilizer, of a section or sections of such boreholed structure in which said stabilizer shall be inserted, and (b) causes said body, to frictionally engage the wall of such borehole, thereby to anchor the boreholed structure, substantially fully along a continuous and substantially full length of said body, with a given, substantially uniformly distributed, anchoring force.

For practical reasons, involving manufacturing simplicity, uniform stocking and warehousing, packaging, and—most significantly—because a few prescribed lengths of four, five or six feet are typically adequate, friction rock stabilizers are mass produced in those lengths as standards. Not infrequently, however, there arises a need for stabilizers of slightly greater lengths. It does occur that the depth of some given earth structures requiring stabilization will be a little greater than the lengths of the available standard friction rock stabilizers. If only four-foot stabilizers are on hand, for instance, for being the type most usable at a site, and a need arises for stabilizing an earth structure through a six foot depth, then (of course) a supply of six foot stabilizers would have to be ordered. This would be so, unless there obtained some facile way of adding a two-foot extension onto a four-foot stabilizer. Accordingly, it is an object of this invention to disclose a method and means to meet this need.

Specifically it is an object of this invention to teach a method of stabilizing an earth structure, such as a roof or wall of a mine shaft, or tunnel, and like subterranean openings, comprising the steps of forming a plurality of concentric boreholes, of discrete diameters in the earth structure; and inserting, in each of said boreholes, a friction rock stabilizer comprising a generally tubular body of substantially one cross-sectional configuration along substantially its full length, said body having a maximum transverse dimension predetermined to be larger than the maximum transverse dimension of the borehole in which it is to be inserted, whereby insertion of said body in such borehole causes circumferential compression and deformation of said body, the stabilizer being free of structure precluding such circumferential compression and deformation of said body, and said body being of material which, in response to such borehole insertion of said stabilizer (a) permits both said circumferential compression of said body, and a transverse deformation thereof as well, in the event of a shift in a plane transverse to the length of said stabilizer, of a section or sections of such boreholed structure in which said stabilizer shall be inserted, and (b) causes said body, to frictionally engage the wall of such borehole, thereby to anchor the boreholed structure, substantially fully along a continuous and substantially full length of said body, with a given, substantially uniformly distributed, anchoring force.

It is also an object of this invention to set forth a friction rock stabilizer, for insertion in a plurality of concentric bores in a structure such as a roof or side wall of a mine shaft, or tunnel, or other underground opening, for anchoring the structure, said stabilizer comprising a plurality of concentric, generally tubular bodies for insertion of each one thereof in a separate one of the concentric bores, each of said bodies being of substantially one cross-sectional configuration along substantially the full length thereof, said bodies each having a maximum transverse dimension predetermined to be larger than the maximum transverse dimension of the one bore, of the plurality thereof, in which it is to be inserted, whereby insertion of said bodies in such bores causes circumferential compression and deformation of said bodies, the stabilizers being free of structure precluding such circumferential compression and deformation of said bodies, and said bodies being of material which, in response to an insertion of said stabilizer in a bored structure, causes each of said bodies to frictionally engage the wall of such one bore in which it shall be inserted, thereby to anchor such bored structure, substantially fully along a continuous and substantially full length of each of said bodies, with a given, substantially uniformly distributed, anchoring force.

It is yet another object of this invention to set forth an axial extension, for a friction rock stabilizer for insertion in a bore in a structure such as a roof or side wall of a mine shaft, or tunnel, or other underground opening for anchoring the structure, in which the stabilizer comprises a generally tubular body of substantially one cross-sectional configuration along substantially the full length thereof, said body having a maximum transverse dimension predetermined to be larger than the maximum transverse dimension of the structure bore in which it is to be inserted, whereby insertion of said body in such bore causes circumferential compression and deformation of said body, the stabilizer being free of structure precluding such circumferential compression and deformation of said body, and said body being of material which, in response to a bore insertion of said stabilizer, causes said body to frictionally engage the wall of such bore, thereby to anchor the bored structure, substantially fully along a continuous and substantially full length of said body, with a given, substantially uniformly distributed, anchoring force, and said body having means fixed to and projecting from a circumferential surface thereof, said axial extension comprising, an elongate element; and means formed on a surface of said element, for effecting a contacting engagement thereof with the projecting means of the body of the stabilizer, and for axially coupling said extension to said stabilizer.

Further objects of this invention, as well as the novel features thereof, will become more apparent by reference to the following description taken in conjunction with the accompanying figures, in which.

Figure 1:
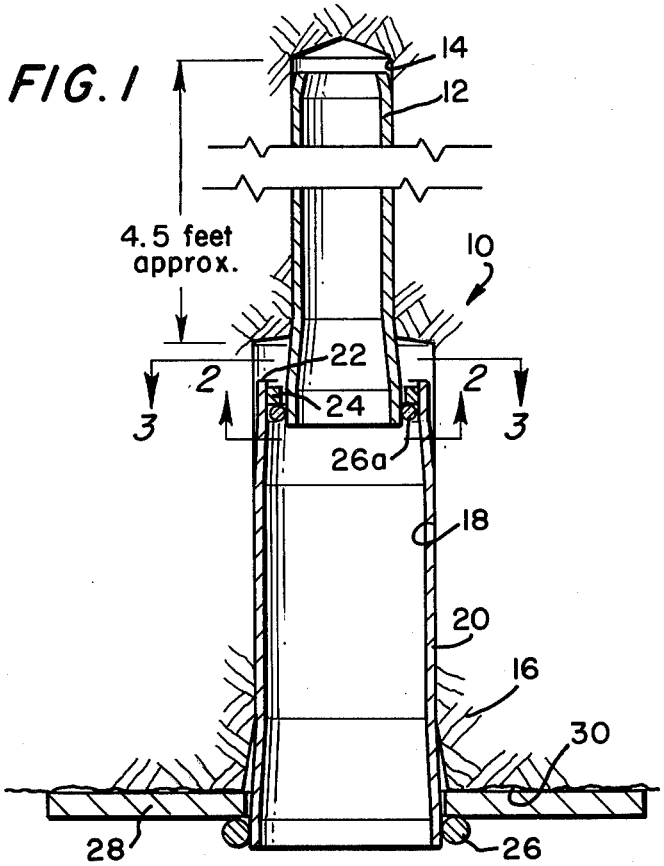
FIG. 1 is an axial, albeit discontinuous, cross-sectional view of an embodiment of the invention shown installed in an earth structure borehole.
Figure 2:
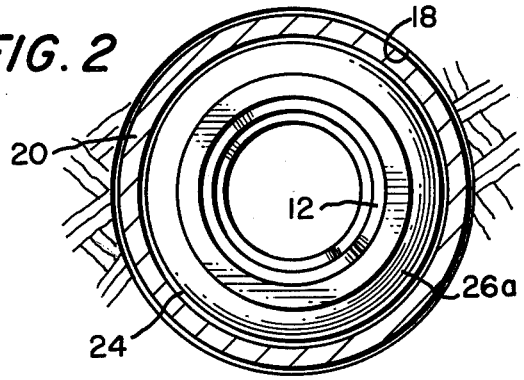
FIG. 2 is a cross-sectional view taken along section 2—2 of FIG. 1, but in approximately twice the scale of FIG. 1.
Figure 3:
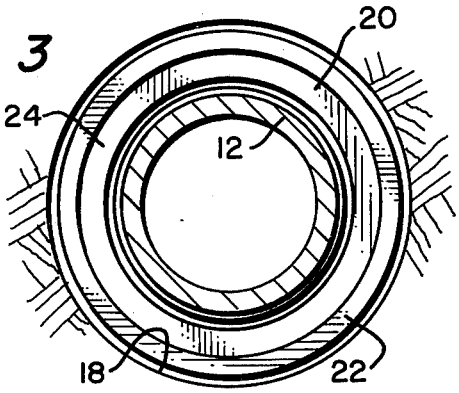
FIG. 3 is a cross-sectional view taken along section 3—3 of FIG. 1, and in a scale corresponding to that of FIG. 2.

As shown in FIGS. 1 through 3 a preferred embodiment 10 of the invention comprises a friction rock stabilizer 12 which substantially conforms to the embodiment thereof set forth in the aforementioned U.S. Pat. No. 3,922,867. According to the teaching in that patent, a borehole 14, having a diameter smaller than that of the diameter of the stabilizer 12, is formed in the earth structure 16. For the purposes of illustration, it is to be assumed that borehole 14 comprises a length of five and a half feet. Proceeding further with the assumption: the depth of structure 16 which requires stabilization is six and a half to seven feet. Accordingly, then, a two to two and a half foot entry portion 18 of the borehole is counter-bored to define the portion 18 concentric with borehole 14. Now then, the structure has a two or two and a half foot entry portion 18 of a relatively large diameter, and a further five to five and a half foot borehole 14, of a relatively small diameter, which penetrates therebeyond. The novel stabilizer 10 comprises the first, a five-foot, friction rock stabilizer 12 which frictionally engages and stabilizes the structure 16 about borehole 14, and a second, axial extension friction rock stabilizer 20, of approximately two feet in length, which frictionally engages and stabilizes the structure about entry portion 18.

The second, axial extension friction rock stabilizer 20 has, at the leading end 22, an annulus 24 welded thereto and therewithin. According to the practice set forth in U.S. Pat. No. 3,922,867, the stabilizer or axial extension 20, for having an overall diameter larger than that of portion 18, is forceably inserted into the latter. The axial extension 20 has a terminal, annular keeper 26 welded thereon which carries an earth retention roof plate 28 therewithin, and which also reinforces the extension 20. Upon the plate 28 coming into engagement with the surface 30 of the structure 16, insertion is terminated. Next, the stabilizer 12 is emplaced.

Stabilizer 12 also has a keeper **26*a* welded thereon which, in this novel practice however, does not serve to carry a roof plate. Rather, stabilizer 12 is forceably inserted into borehole 14 until its keeper 26*a* comes into engagement with the annulus 24 (on stabilizer or axial extension 20). Thereupon insertion of stabilizer 12** is terminated.

Figure 4:
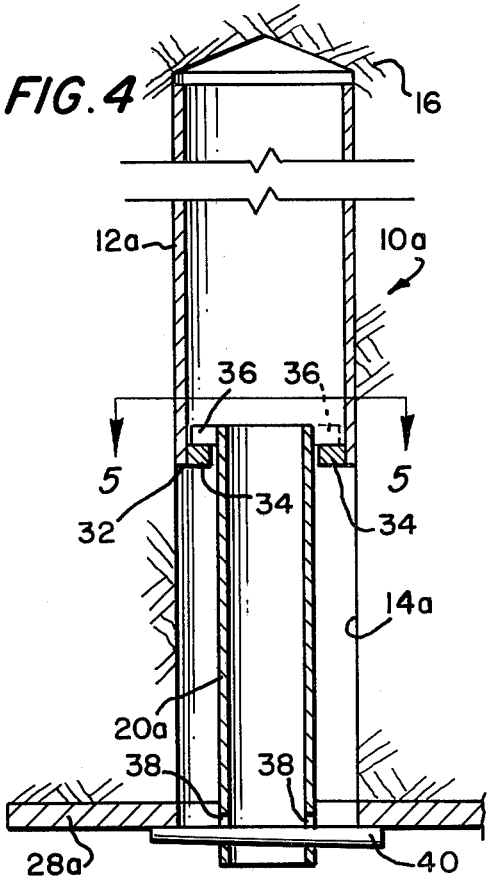
FIG. 4 is a view like that of FIG. 1, but of an alternative embodiment of the invention.
Figure 6:
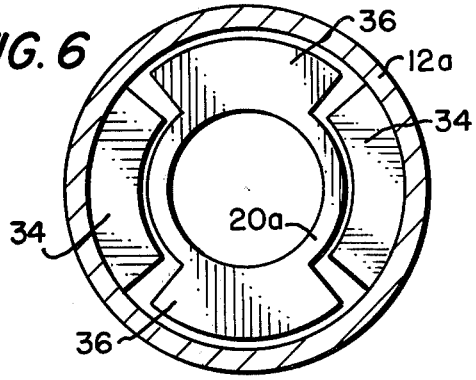
FIG. 6 is a cross-sectional view in the same scale as, and corresponding to section 5—5 of FIG. 4 showing, however, the axial extension piece oriented for prelocking insertion.

Through the contacting engagement of annulus 24 and keeper **26*a*, the two earth structure stabilizing elements, stabilizer 12 and stabilizing axial extension 20, secure the structure 16 through a full seven foot depth, and fix the roof plate 28 securely against the structure 16**.

Where an axial extension is required simply to bridge a short borehole length, say of one to two feet, for coupling thereof to a friction rock stabilizer and for securing a roof plate therebelow, an alternative embodiment of my invention may be employed. Such is depicted in FIGS. 4 through 6.

The alternative embodiment **10*a* comprises a friction rock stabilizer 12*a* for forced insertion thereof in a borehole 14*a*. Within, and slightly recessed from the "lower" end 32 of the stabilizer 12*a*, are welded diametrically opposed segments 34. An axial extension 20*a*, also having diametrically opposed segments 36 welded thereon at the "upper" end 38 thereof engages and locks with the stabilizer 12*a***.

Figure 5:
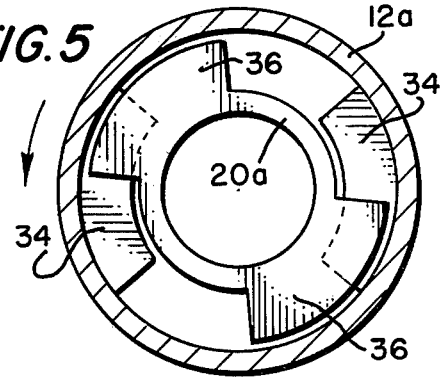
FIG. 5 is a cross-sectional view taken along section 5—5 of FIG. 4, in a scale twice that of FIG. 4.

FIG. 5 illustrates the axial extension **20*a* partially "locked" into position, with the segments 36 slidably surmounting the segments 34; the arrow denotes the rotary direction for effecting the locking engagement. FIG. 6 illustrates the proper relative orientations of stabilizer 12*a* and axial extension 20*a*, to facilitate the passage of the segments 36 through the segments 34**—for slidable engagement therewith.

The aforementioned U.S. Pat. No. 3,922,867 disclosed the use of slots and a tensioning wedge for fastening a roof plate in place. This FIGS. 4 through 6 embodiment **10*a* comprehends the use of such slots 38 in the "lower" end of the axial extension 20*a*—at opposite sides thereof—to receive the tensioning wedge 40 therethrough for fixing the roof plate 28*a*** in position.

Clearly, the axial extension **20*a* offers no direct stabilization of the earth structure 16; it serves substantially only to axially extend the stabilizer 12*a* and to support and fasten the roof plate 28*a*. The use of this embodiment 10*a*, then, may be appropriate where the extension required for the stabilizer 12*a* is limited (i.e., one to two feet, perhaps) and the nature of the attendant circumstances are such that stabilizer 12*a* substantially satisfies the necessary earth structure 16** stabilization.

While I have described my invention in connection with specific embodiments thereof, it is to be clearly understood that this is done only by way of example, and not as a limitation to the scope of my invention as set forth in the objects thereof and in the appended claims.

I claim:

1. A method of stabilizing an earth structure, such as a roof or wall of a mine shaft, or tunnel, and like subterranean openings, comprising the steps of:

forming a plurality of concentric boreholes, of discrete diameters in the earth structure; and inserting, in each of said boreholes, a friction rock stabilizer comprising a generally tubular body of substantially one cross-sectional configuration along substantially its full length; wherein said stabilizers inserting step comprises inserting a first friction rock stabilizer in a first of said boreholes of said plurality thereof, and then passing a second friction rock stabilizer through said first stabilizer and inserting said second stabilizer in a second of said boreholes.

2. A method, according to claim 1, wherein:

said forming step comprises forming a first of said plurality of boreholes, initially, and then forming a second of said boreholes as a counterbore of said first borehole.

3. A method, according to claim 1, wherein:

said forming step comprises forming a first of said plurality of boreholes, initially, to a given depth, and then forming a second of said boreholes centrally of said first borehole and beyond said given depth.

4. A method of stabilizing an earth structure, such as a roof or wall of a mine shaft, or tunnel, and like subterranean openings, comprising the steps of:

forming a plurality of concentric boreholes, of discrete diameters in the earth structure; and inserting, in each of said boreholes, a friction rock stabilizer comprising a generally tubular body of substantially one cross-sectional configuration along substantially its full length; wherein said stabilizers inserting step comprises inserting both first and second friction rock stabilizers in a first of said boreholes of said plurality thereof, and then inserting one of said first and second stabilizers in a second of said boreholes.

5. A method, according to claim 1, further including the step of:

coupling said stabilizers together.

6. A method, according to claim 5, wherein:

said coupling step is performed following insertion of one of said stabilizers, and substantially coincident with completion of insertion of a second of said stabilizers.

7. A method of stabilizing an earth structure, such as a roof or wall of a mine shaft, or tunnel, and like subterranean openings, comprising the steps of:

forming a plurality of concentric boreholes, of discrete diameters in the earth structure; and inserting, in each of said boreholes, a friction rock stabilizer comprising a generally tubular body of substantially one cross-sectional configuration along substantially its full length; further including the step of:

fixing prominent elements on proximately adjacent surfaces of said stabilizers to cause a closure of said elements into mutually contacting engagement and a resultant coupling together of said stabilizers.

8. A friction rock stabilizer, for insertion in a bore in a structure such as a roof or side wall of a mine shaft, or tunnel, or other underground opening, for anchoring the structure, said stabilizer comprising a plurality of concentric, generally tubular bodies, each of said bodies being of substantially one cross-sectional configuration along substantially the full length thereof, at least one of said bodies having a maximum transverse dimension predetermined to be larger than the maximum transverse dimension of the bore, whereby insertion of said one body in such bore causes circumferential compression and deformation of said one body, the stabilizer being free of structure precluding such circumferential compression and deformation of said one body, and said one body being of material which, in response to an insertion of said stabilizer in such bore, causes said one body, to frictionally engage the wall of such bore, thereby to anchor the bored structure, substantially fully along a continuous and substantially full length of said one body, with a given, substantially uniformly distributed, anchoring force; further comprising means coupling said bodies together; and wherein said coupling means comprises prominent elements, fixed on proximately adjacent surfaces of said concentric bodies, which close into mutually contacting engagement.

9. A friction rock stabilizer, according to claim 8, wherein:

one of said elements comprises an annulus fixed on an outer surface of one of said bodies; and another of said elements comprises an annulus fixed on an inner surface of another of said bodies.

10. A friction rock stabilizer, according a claim 8, wherein:

each of said elements is fixed on said surface, of its respective body, immediately adjacent to an end of said respective body.

* * * * *